United States Patent [19]

Wilson

[11] 3,999,491

[45] Dec. 28, 1976

[54] ELEVATIONALLY ADJUSTABLE FOLDING STAGE

[76] Inventor: Kermit H. Wilson, 7001 Antrim Road, Edina, Minn. 55435

[22] Filed: Dec. 5, 1975

[21] Appl. No.: 638,167

[52] U.S. Cl. ..... 108/113

[51] Int. Cl.[2] ..... A47B 3/00

[58] Field of Search ..... 108/19, 112, 113

[56] References Cited

UNITED STATES PATENTS

| | | | |
|---|---|---|---|
| 2,645,539 | 7/1953 | Thompson | 108/113 |
| 2,978,754 | 4/1961 | Wilson | 108/112 |
| 3,351,029 | 11/1967 | Bue | 108/112 |

FOREIGN PATENTS OR APPLICATIONS

| | | | |
|---|---|---|---|
| 1,041,643 | 10/1958 | Germany | 108/19 |

*Primary Examiner*—James C. Mitchell
*Attorney, Agent, or Firm*—Merchant, Gould, Smith, Edell, Welter & Schmidt

[57] ABSTRACT

An elevationally adjustable folding stage with simplified one-man adjustment of height. The stage has two rectangular stage portions which are pivotable towards each other to a vertical storage position centered over a base frame containing main support legs. Outer support legs attached to the outer ends of the two stage members are adustable in length. Auxiliary support legs which are longer than the main support legs are mounted to the undersides of the two stage members adjacent the main support legs. For lower stage position, the auxiliary legs are folded up, and for the higher stage position the auxiliary legs are brought to their extended position while the stage members are folded. As the stage members are brought down to their horizontal position, a rocking action about the extended auxiliary leg lifts the stage to the upper position. The auxiliary legs and outer legs are optionally extendable to another higher position. In a preferred embodiment, the auxiliary legs have a curved ground contact portion to assist in the rocking action.

14 Claims, 5 Drawing Figures

FIG. 2
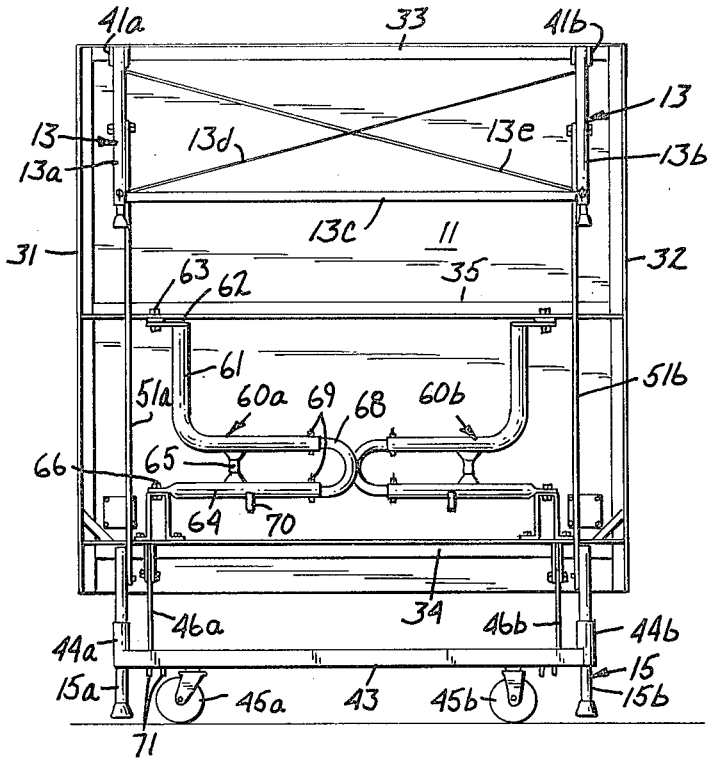
FIG. 3
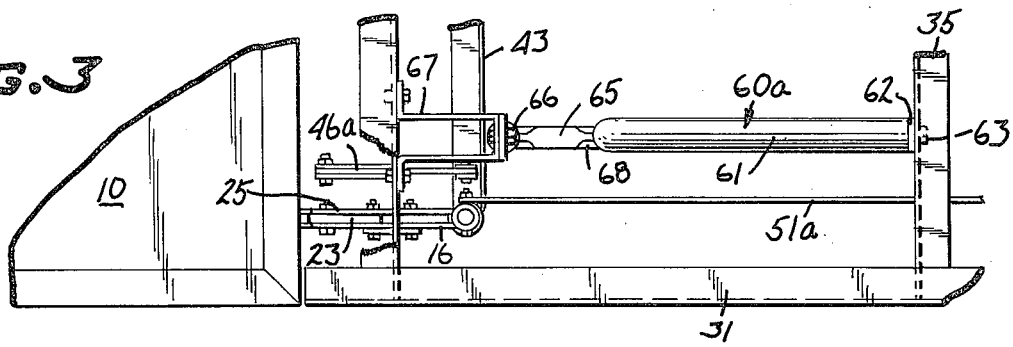
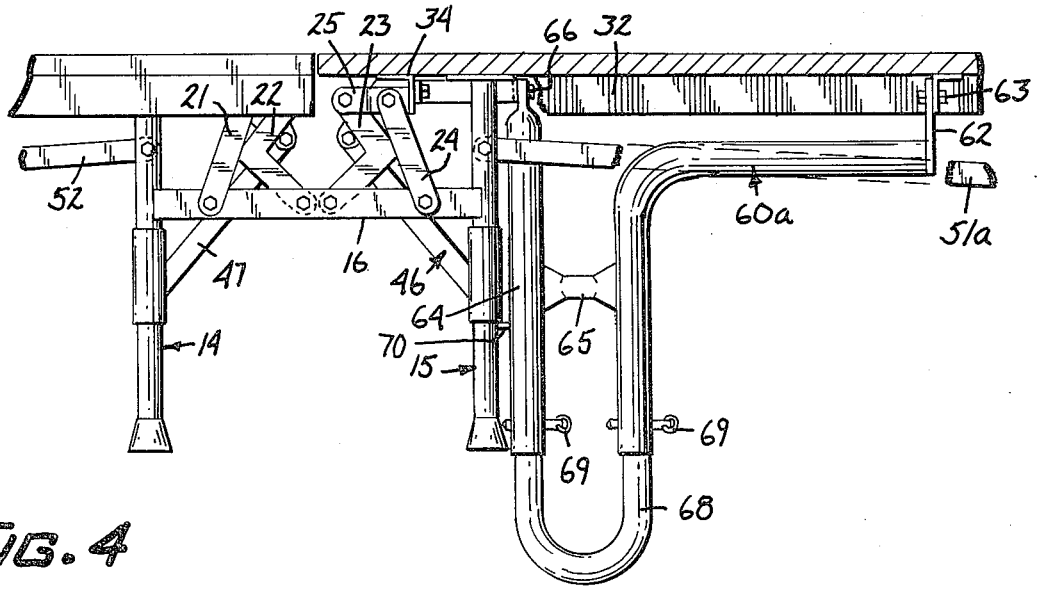
FIG. 4

ELEVATIONALLY ADJUSTABLE FOLDING STAGE

BACKGROUND OF THE INVENTION

The present invention pertains to improvements in foldable stages and more particularly to an improved and simplified elevationally adjustable folding stage.

Foldable portable stages have become very popular and widely used in multi-purpose rooms or areas wherein differing use requirements dictate rapid setup and take-down capability of the stage. One example of a prior art folding mobile stage is found in U.S. Pat. No. 3,351,029 issued to R. C. Bue.

It has been recognized that even greater versatility of use could be achieved if a simple and convenient elevational adjustment could be provided for a portable folding stage. One type of elevationally adjustable foldable stage is disclosed in copending patent application Ser. No. 626,979 by Kermit H. Wilson, Richard C. Bue and Ronald R. Carlson, filed Oct. 29, 1975. The present invention provides yet another means for elevational adjustment of folding stage that is somewhat simpler in construction and is easier to adjust in height.

SUMMARY OF THE INVENTION

The present invention provides a simple and convenient elevational adjustment feature for a foldable stage of the type having first and second surface members, first and second main support legs interconnected to form a base frame for supporting the stage in its folded position, and means for pivotally mounting the first and second stage surface members to the base frame for pivotal movement between a storage position in which the members are generally vertically positioned above the base frame, and an operable position in which the stage members are horizontally positioned to define a common stage surface. Pairs of outer legs are attached to each of the stage surface members at their opposite ends, remote from the pivotal connection to the base frame, and means are provided for adjusting the length of said outer legs. Auxiliary support legs are mounted to the underside of the first and second stage surface members relatively adjacent the ends thereof which are pivotally connected to the base frame. The auxiliary legs are adjustable between a first inoperative position and a second operable position in which they extend from the stage surface members a distance greater than that of the main support legs. In a preferred embodiment, the feed of the auxiliary legs have a curved configuration to facilitate in a rocking or pivoting motion thereabout so as to make easier and more convenient the transition of the stage from its folded position into its operative, extended height position.

BRIEF DESCRIPTION OF THE DRAWINGS

In the drawing,

FIG. 2 is a view in side elevation of the folding stage of FIG. 1 in a storage position;

FIG. 3 is an enlarged fragmentary detail in top plan of a portion of FIG. 1, portions thereof removed for purposes of clarity;

FIG. 4 is an enlarged view in side elevation of a portion of the elevationally adjustable folding stage of FIG. 1.

DESCRIPTION OF THE PREFERRED EMBODIMENT

Although the elevationally adjustable feature of the present invention could be used with many types of folding stages, in the presently preferred embodiment the invention is used in conjunction with the prior art type of folding stage disclosed in U.S. Pat. No. 3,351,029; and the preferred embodiment as illustrated herein shows the elevationally adjustable feature of the present invention applied to that type of folding stage.

Figure 1:
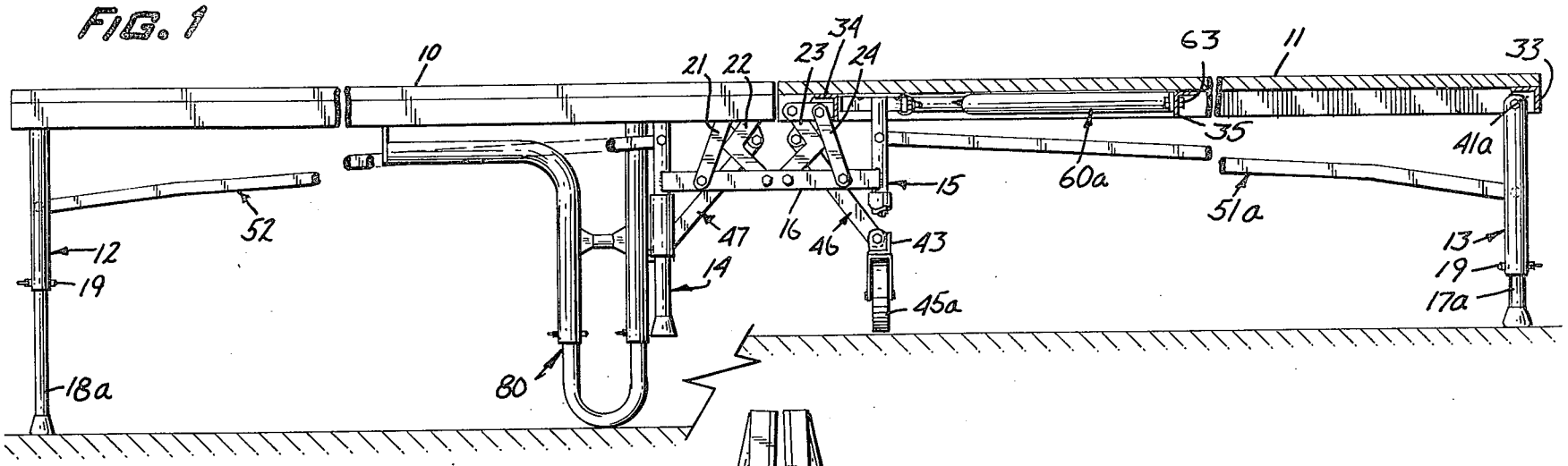
FIG. 1 is a view in side elevation, portions thereof broken away for clarity, of an elevationally adjustable folding stage according to the present invention, one half thereof being indicated in raised position for illustrative purposes.

The stage of FIG. 1 comprises a pair of stage surface members 10 and 11. In FIG. 1, the stage is shown in its open or operable position in which the stage surface members 10 and 11 are positioned adjacent each other to form a continuous stage surface. Stage member 11 is supported at its outer end by an outer leg assembly generally indicated by reference numeral 13. Similarly, stage surface member 10 has a corresponding outer leg assembly 12, which is shown in its extended position as explained hereinafter. At their ends which are adjacent to each other, stage surface members 10 and 11 are supported by main support leg assemblies 14 and 15 respectively. These main support leg assemblies are interconnected by means of a brace 16, so that the main support leg assemblies 14 and 15 and brace 16 together form a base frame. Member 10 is pivotally connected to the base frame by means of links 21 and 22, while member 11 is pivotally connected to the base by means of links 23 and 24. Only one side of the structure is shown in FIG. 1, but it will be appreciated that links 21–24 have corresponding parts on the other side of the structure which cooperate to hingeably mount the stage surface members to the base frame.

As shown in FIG. 2, stage member 11 has a plurality of support or reinforcing rails, including angle irons 31 and 32 along each side, angle iron 33 along one end, angle iron 34, which is placed slightly away from the other end, and angle iron 35 across the center. Together, these angle irons form a framework for supporting and reinforcing the actual stage surface member itself, and provide a means for attaching the legs and various components.

Also as shown in FIG. 2, outer leg assembly 13 has a pair of individual legs **13*a* and 13*b*, one on either side which are pivotally mounted to reinforcing member 33 by means of suitable pivotal mounts 41*a* and 41*b*. In the preferred embodiment, these pivots may be a pair of tabs welded to member 33, with a pivot bolt passing through the tabs and the upper end of the leg. At the lower end of legs 13*a* and 13*b*, there is a cross member 13*c*. A pair of cross brace wires 13*d* and 13*e*** may be provided for additional rigidity.

A cross member 43 extends between means support legs **15*a* and 15*b* which are positioned on either side of the table. Sliding collars 44*a* and 44*b* fit coaxially around legs 15*a* and 15*b* and are attached to cross member 43. Caster wheels 45*a* and 45*b* are attached to cross member 43**.

As better shown in FIG. 4, a pair of links 23 and 24 are pivotally connected to a bracket 25 which is attached to frame reinforcing member 24. The other ends of links 23 and 24 are pivotally connected to brace 16. A similar construction is used for connecting member 10 to brace 16 by means of links 21 and 22. Portions of the stage member reinforcing rail have been broken away from the member 11 to more clearly show the details of connection. Another pair of links 46 and 47 connect from the sliding collars on the main support legs to brackets which in turn are mounted to frame reinforcing member 34.

An outer leg control link 51*a* connects from main support leg 15*a* to outer leg 13*a*. As seen in FIG. 2, the equivalent control link 51*b* is found on the other side of the stage surface member. Also, as seen in FIG. 1, a corresponding control link 52, is provided for stage surface member 10. This link likewise has left and right portions but only one side is visible in FIG. 1.

Figure 5:
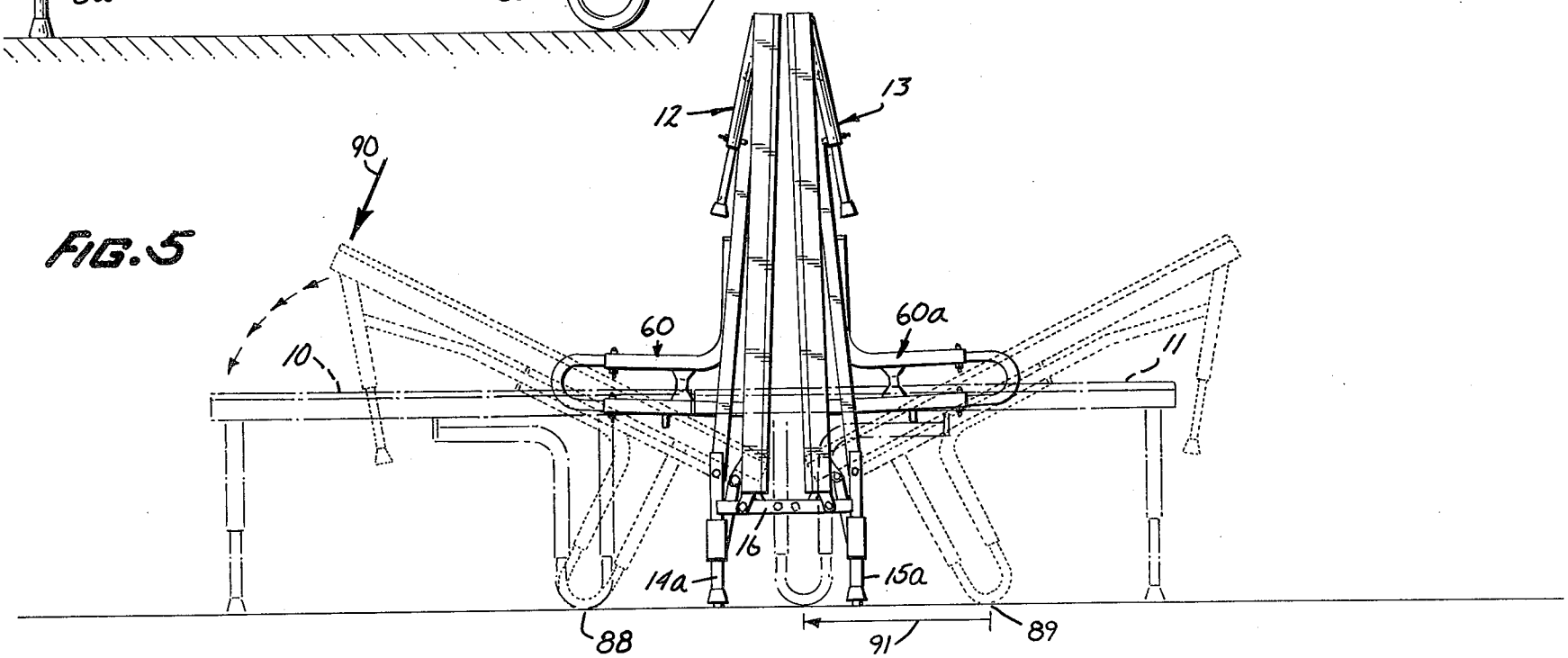
FIG. 5 is a diagrammatic view in side elevation illustrating the folding and elevationally adjustment according to the present invention.

The details of construction and operation of the elements thus far described are set forth in greater detail in U.S. Pat. No. 3,351,029 previously referred to. Briefly, the folding stage may be folded up by swinging the outer portions of both stage surface members 10 and 11 upward to where they meet in a vertical plane above the base frame. The upward pivoting movement is made possible by pivoting links 21–24, and at the same time links 46 and 47 cause the sliding collars 44 to slide downward bringing the wheels 45*a* and 45*b* into contact with the ground and lifting main support legs 14 and 15 slightly off the surface. Also during the folding motion, control links 51 and 52 fold outer leg assemblies 12 and 13 inward against the undersurface of stage surface members 10 and 11. The resulting folding position, as indicated in FIG. 2 and in the solid line portion of FIG. 5, represents a compact storage arrangement that permits the stage to be wheeled away to a storage area.

According to the present invention, elevational adjustment is accomplished primarily by means of auxiliary support legs. As seen in FIG. 2, a pair of leg structures 60*a* and 60*b* are provided on stage surface member 11. The following detailed description is given with respect to leg 60*a*, but it will be appreciated that the same description applies with respect to leg 60*b*.

In the preferred embodiment, auxiliary support leg 60*a* has a generally L-shaped tubular section 61. A bracket 62 is welded to one end of tubular member 61, and bracket 62 is pivotally connected to cross brace reinforcement member 35 by means of a pivot bolt 63. Another tubular section 64 is provided generally parallel to a portion of tubular member 61, and a brace 65 may be welded therebetween to hold them in position. A tab welded to one end of tubular member 64 is pivotally connected by means of a pivot bolt 66, to an angle bracket 67 which is bolted or welded or otherwise attached to cross brace angle bracket 34.

A U-shaped foot member 68 is made of a tubular member having a small enough diameter to fit inside the open ends of tubular members 61 and 64. This foot member 68 is held in place by pins 69 passing through holes provided therein. Additional holes may be provided in the straight portions of foot member 68, so that different adjustment heights are possible by pulling member 68 further out and reapplying the pins 69 in the other holes.

A tab 70 is welded to a portion of tubular member 64 in such a position as to fit between mating tabs 71 provided along the bottom of cross brace 43. Tabs 70 and 71 serve to positively locate and laterally stabilize the auxiliary legs when they are in their down position.

Means are provided for adjusting the length of the outer leg assemblies. As shown in FIG. 1, in the preferred embodiment outer leg 13*a* is tubular in configuration, and has a telescoping inner portion 17*a*. Similarly, portion 18 fits telescopically inside outer leg 12 of the other portion of the stage. The telescopic inner portions of the legs are held in positions by means of pins or bolts 19, and a plurality of holes are provided in the telescopic inner portions so that different adjustment heights are possible. The lowest adjustment height position corresponds to the length of the main support legs 14 and 15, while additional adjustment height positions correspond to different adjustment heights of the foot portions 68 of the auxiliary support legs.

As shown in FIG. 1, stage surface member 10 has a pair of auxiliary support legs designated by reference numeral 80 (only one of which is visible in the side view of FIG. 1) and these correspond to auxiliary support legs 60*a* and 60*b*, previously described, or stage surface member 11.

For illustrative purposes, FIG. 1 is divided showing the left hand portion of the stage set in an elevated position, with the right-hand portion set in its lowest position. In its lowest position, the stage rests on main support legs 14 and 15 and the outer leg assemblies when set to their lowest height; and the auxiliary support legs are folded up. In its elevated position or positions, the stage rests upon auxiliary support legs 60 and 80, and the outer leg assemblies in their extended position or positions.

The operation of the invention in adjusting the stage from a low position to a higher position will now be described with primary reference to FIG. 5. In FIG. 5, the solid line portion indicates the stage folded up in its storage position, with stage surface members 10 and 11 adjacent each other in a vertical position over the base frame. After wheeling the stage to the desired location in the room, the auxiliary support legs 60 and 80 (two per side) are pivoted outward to a position wherein they are perpendicular to their respective stage surfaces. The adjustable U-shaped telescoping foot portion of each of the auxiliary support legs can at this time be adjusted to the desired height and the pins reinserted to hold them in that position. The two stage surface members 10 and 11 are then manually pivoted outward and downward, one at a time, to the intermediate position indicated by the dotted lines in FIG. 5. In this position, the foot portion of the auxiliary support legs just contacts the floor at points 88 and 89, thereby stopping the pivoting of the stage momentarily. In this position, the outer leg assemblies 12 and 13 can be adjusted by removing the pins 19 and pulling the telescoping inner portions out to a position corresponding to the height previously set on the auxiliary support legs. The pins are then reinserted in the outer leg assemblies.

To finish erecting the stage, the person opening the stage selects either side, and simply pushes downward on the end of the stage surface member. Either side can be used, but for purposes of explanation, assume that the operator selects to push downward on the left-hand side, on the end of stage surface member 10, as indicated by arrow 90 in FIG. 5. The force thus applied causes stage surface member 10 to pivot about the auxiliary support leg 80, and downward to the operational position indicated by the broken lines in FIG. 5. As the left end of stage member 10 is brought down into position, its right end, which is connected to the main support legs and the base frame, is lifted upward, lifting the main support legs off the floor. At the same time, stage surface member 11 is pivoted to its horizontal position and pulled to the left a distance indicated by arrow 91. It should be pointed out that the pivoting motion has the effect of lightening the half of the stage which is being slid into position, thereby minimizing any danger of marring the floor.

It is thus apparent that the auxiliary support legs, in addition to providing the extra height required for elevational adjustment, also serve in a unique manner as a rocking point or pivot when erecting the stage to its higher position. For this purpose, in the preferred embodiment the foot portion 68 of the auxiliary support legs is configured with a curved portion. This curved portion facilitates the rocking or pivoting movement, making it easier and smoother for the operator to apply the downward force 90 while at the same time minimizing any marking or scuffing of the floor. By the same token, the curved foot serves as a skid, allowing the auxiliary support leg on the other side to slide laterally across the floor a short distance into position as indicated by arrow 91, further minimizing any marking of the floor.

It will also be apparent that other shapes and configurations could be used for the auxiliary support legs, while still achieving the primary function of the present invention. For example, a caster wheel could be used at the foot of the auxiliary support leg to provide the pivoting or rocking motion, as well as a rolling motion when the other side is pulled into place. However, in stages intended for carrying very heavy loads while in use, the structure shown in the drawings would be preferred. Alternatively, a flat platform foot portion pivotally connected to the bottom of the auxiliary support legs could be used.

It should be further appreciated that the rocking or pivoting action described above for final setup of the stage to its elevated position is much more convenient, and requires much less effort than would be the case if workmen were required to lift and hold the stage while another workman was required to telescopically adjust the legs. Further, the relatively great leverage provided from the end of the stage to the pivot point at the foot of the auxiliary support leg further eases the setup operation.

Resetting the stage to a folded or a lower position is accomplished by a reverse operation of the steps set forth above.

Thus it will be seen that the present invention provides an improved elevationally adjustable foldable stage, having a simplified construction and providing simplified and convenient one-man operation in setting up the stage to higher elevations.

I claim:

1. In a foldable stage of the type having first and second stage surface members, first and second main support legs interconnected to form a base frame for supporting the stage in its folded position, means for hingeably mounting said first and second stage surface members to said base frame for pivotal movement of said members between a storage position in which some members are generally vertically positioned above the base frame with the surfaces adjacent each other and an operable position in which the stage surface members are horizontally positioned to define a stage surface, pairs of outer legs attached to each of said stage surface members remote from said hinge connection to said base frame, the improvement which comprises auxiliary support legs mounted to said first and second stage surface members adjacent the ends thereof which are hingeably interconnected to said base frame, said auxiliary legs adjustable between a first inoperable position and a second operable position in which they extend from the stage surface members a distance greater than the main support leg, and means for adjusting the length of said outer legs, whereby the stage height can be adjusted by adjusting the length of said outer legs and adjusting said auxiliary legs.

2. Apparatus according to claim 1 wherein said auxiliary support legs have a curved foot portion for permitting a pivoting or rocking motion thereabout during setup of the stage.

3. Apparatus according to claim 1 wherein said auxiliary support legs are pivotally connected to the underside of said first and second stage surface members, for folding laterally to said inoperable position generally parallel to their respective stage surface members.

4. Apparatus according to claim 3 wherein locating tabs are positioned on said auxiliary support legs and said base frame, and aligned for abutment when said auxiliary support legs are in their operable position, so as to laterally locate and stabilize the auxiliary support legs when the stage is in its operable position.

5. Apparatus according to claim 1 wherein said auxiliary support legs are telescopically adjustable in length so as to provide further elevational adjustment for said stage.

6. Apparatus according to claim 1 wherein said auxiliary support legs comprise generally U-shaped members having their upper portions pivotally connected to the underside of said first and second stage surface members for lateral folding thereagainst, and having a curved foot portion for contacting the floor surface when the stage is in its horizontally extended position, and for facilitating pivoting or rocking movements thereabout during setup of the stage.

7. A foldable, height adjustable stage comprising:

a. first and second main support legs interconnected to form a base frame;

b. first and second stage surface members;

c. means hingeably connecting said first and second stage surface members to said base frame for movement between a storage position wherein said stage surface members are generally vertically disposed above said base frame, and an operable position in which said stage surface members are generally horizontally disposed to define a continuous stage surface;

d. first and second outer leg means connected to said first and second stage surface members, respectively, remote from said base frame for supporting said stage surface members when in their operable position;

e. means for adjusting the length of said first and second outer leg means;

f. first and second auxiliary support leg means mounted respectively to said first and second stage surface members adjacent the hingeable connection thereof to said base frame; and g. means for adjusting said auxiliary leg means between a storage position and an operable position in which said support legs extend outward from said stage surface members farther than said main support legs, whereby said stage may be elevated by lengthening said outer legs, adjusting said auxiliary legs to their operable position, and pivoting said stage surface members to their operable position thereby lifting the base frame and main support legs off the floor.

8. A stage according to claim 7 wherein said first and second auxiliary support leg means each comprise a pair of legs pivotally connected to the underside of their respective stage surface members for lateral folding to their folded position.

9. A stage according to claim 8 further including locating tabs positioned on said auxiliary legs and base frame and aligned with one another for abutment when the auxiliary leg means are in their operable position, so as to laterally locate and stabilize the auxiliary support legs.

10. A stage according to claim 7 wherein said auxiliary support leg means have curved foot portions for contact with the floor surface, for facilitating rocking or pivoting motion of the stage thereabout during stage setup.

11. A stage according to claim 7 wherein said first and second auxiliary support leg means comprise a plurality of legs, each leg comprising a U-shaped member having upper parts connected to said stage surface member and having a lower curved portion for contact with the floor surface when it is in its operable position.

12. A stage according to claim 11 wherein said lower curved portion is telescopically adjustable with respect to said upper portions of said U-shaped leg member for providing further height adjustment for said stage.

13. A stage according to claim 12 wherein said U-shaped auxiliary support leg members are pivotally connected to their respective stage surface members for lateral fold-up to said storage position beneath said stage surface member, and further including locating tabs positioned on said main support legs and said base frame and aligned for abutment to laterally locate said auxiliary support legs when in their operable position.

14. A stage according to claim 7 wherein said means for adjusting said auxiliary leg means includes inner and outer tubular members telescopically adjustable for adjusting the length of said auxiliary leg means.

* * * * *